US005477797A

United States Patent [19]

Stuart

[11] Patent Number: 5,477,797

[45] Date of Patent: Dec. 26, 1995

[54] WATERCRAFT HULL MODIFICATION

[76] Inventor: William Stuart, 3402 Golders Green Dr., Houston, Tex. 77082

[21] Appl. No.: 70,431

[22] PCT Filed: Dec. 4, 1991

[86] PCT No.: PCT/GB91/02148

§ 371 Date: Jul. 30, 1993

§ 102(e) Date: Jul. 30, 1993

[87] PCT Pub. No.: WO92/10396

PCT Pub. Date: Jun. 25, 1992

[30] Foreign Application Priority Data

Dec. 5, 1990 [GB] United Kingdom ..... 9026444
May 3, 1991 [GB] United Kingdom ..... 9109719

[51] Int. Cl.[6] ..... B63B 3/02

[52] U.S. Cl. ..... 114/65 R; 114/74 A; 114/125

[58] Field of Search ..... 114/65 R, 74 R, 114/74 A, 79 A, 125, 357

[56] References Cited

U.S. PATENT DOCUMENTS

| | | | |
|---|---|---|---|
| 2,833,682 | 5/1968 | De Laszlo | 114/357 X |
| 3,680,516 | 8/1972 | Loverdos-Stelakatos | 114/67 R |
| 3,736,608 | 6/1973 | Whitehead | 114/125 |
| 3,831,212 | 8/1974 | Moore et al. | 114/65 R |
| 4,162,658 | 7/1979 | Okabe et al. | 114/74 R |
| 4,712,499 | 12/1987 | Haruguchi et al. | 114/77 R |

FOREIGN PATENT DOCUMENTS

| | | |
|---|---|---|
| 3128822 | 3/1983 | Denmark . |
| 2372072 | 6/1978 | France . |
| 2449033 | 9/1980 | France . |
| 1082982 | 9/1967 | United Kingdom . |
| 2044184 | 10/1980 | United Kingdom . |
| 2143184 | 2/1985 | United Kingdom . |
| 2143182 | 2/1985 | United Kingdom . |

OTHER PUBLICATIONS

A Group of Authorities 'ship design and construction' 1969, Society of Naval Architects and Marine Engineers, New York, pp. 197–199.

*Primary Examiner*—Sherman Basinger

[57] ABSTRACT

A method of constructing or, modifying a watercraft (10) comprises the step of fitting to a main hull (14) of the watercraft an outer hull structure (15) which includes or which forms an outer hull skin (22) by attaching the outer hull structure (15) to the external surface of the main hull (14) of the watercraft. The outer hull structure (15) provides fluid containment spaces (155) between the outer hull skin (22) and the main hull (14) and a communication is provided for flooding the spaces (155) with water from the body of water within which the craft moves. The fluid containment spaces (155) extend above the waterline of the watercraft and means are provided for supplying a pressurized inert gas and/or for applying vacuum pressures to preselected sections of the outer hull structure (15) so that the water levels in those sections can be brought above or below the waterline of the watercraft to increase the overall ballast effect or the buoyancy or to alter the trim of the watercraft (10).

9 Claims, 8 Drawing Sheets

WATERCRAFT HULL MODIFICATION

FIELD OF THE INVENTION

The present invention relates to watercraft hull modification and is particularly although not exclusively concerned with hull modification to oil tanker vessels and other ships engaged in the trade of carrying liquids which would, if the hull were broached, present a potential hazard to the environment and an economic risk of losing cargo.

DESCRIPTION OF THE BACKGROUND ART

Most ships currently engaged in the carriage of oil have a single hull or single skin usually referred to as a single bottom. If they run aground or collide with a submerged object or are involved in a collision with another vessel, they readily lose their cargo on the broaching of the hull, bottom or side, as was the case with the Exxon Valdez.

The provision of double hulls on tankers to avoid or at least reduce the loss of cargo following damage to the hull, bottom or side has been the subject of discussion for many years.

In general, the provision of a double hull has not been considered economical although the introduction of double hulls is most desirable from an antipollution point of view.

It is known to fit to an existing watercraft by way of a retrofit an additional hull internally of the main hull. In a known method an inner hull skin is fitted extending across the bottom of the ship and supported by transverse framing built up from the existing main hull bottom of the ship.

It is also known to build vessels with an additional hull or bottom, e.g. by building both hulls from sub-assemblies in sandwich-like form with inner and outer hull functions in each assembly, and then assembling these sub-assemblies on a building slip or in a dock.

Another method, more dramatic, is to cut off the existing single hull bottom structure and replace it with a newly constructed double bottom structure. This method has been applied to tankers with major grounding damage.

A retro fit of hull sides which is relatively common is the fitting of sponsons to the sides of a ship, which act essentially as buoyancy tanks and which are added to provide the ship with a greater water plane area and inertia and increase the carrying capacity of the ship. This is often done when the naval architects have made a design error, or when the owner or operator requires a change in the characteristics of the ship.

With known double bottomed watercraft, whether the double bottom was a feature of the craft initially or added internally as a retrofit, the spaces between the outer and inner hulls are left as void spaces. There is a risk that leakage of cargo into these spaces will occur, and so efficient monitoring systems are required for these spaces, as otherwise contamination of any ballast stored in the spaces may occur or there may be dangerous build up of explosive gases in the spaces.

Free flooding of void spaces in underwater structures is known in relation to oil platform jacket legs to prevent hydrostatic collapse of these deep water structures when it becomes uneconomic to build the legs to a size to withstand the hydrostatic pressure encountered at that depth.

There is one case common in ship design where a small compartment is free flooded and that is a sea water chest. A sea water chest is a small compartment having a volume of between 1 and 10 meters cubed, which is free flooded for pipe connections and which is used as a source of salt or fresh water for the convenience of the ship's piping systems as a water inlet. This compartment is always on the shell hull, and can be and sometimes is located between the outer and inner bottom.

It is well known to fit fenders to the sides of ships and boats to protect specific areas of the hull from contact damage. Fenders are typically corrugated with sections between 12 and 14 inches deep and are fitted to vessels, such as tugs, supply boats and ferries that are frequently involved in berthing and other operations in which contact with other vessels occurs. Fenders are fitted to the sides of the vessels usually above the water-line of the vessel and are to protect the vessel from damage by contact with docks or with other vessels. Fenders are fitted only to those selected parts of the vessel that come into contact with docks or other vessels.

SUMMARY OF THE INVENTION

According to a first aspect of the present invention there is provided a method of constructing or modifying a watercraft comprising the step of fitting to at least a bottom part of a main hull of the watercraft an outer hull structure which includes or which forms an outer hull skin by attaching the outer hull structure to the external surface of the main hull of the watercraft in such a manner that at least a part of the outer hull skin is spaced from the main hull.

In embodiments of the invention hereinafter to be described the outer hull structure is such as to provide fluid containment spaces between the outer hull skin and the main hull and wherein a communication is provided for a flow of water to the fluid containment spaces.

In an embodiment of the invention hereinafter to be described the flow of water to the spaces is supplied from the body of water within which the craft moves and the communication providing the flow of water to the water containment spaces comprises openings in the outer hull skin extending across the bottom part of the craft.

In the embodiments of the invention hereafter to be described, the outer hull structure is fitted to the bottom and to each side of the main hull and the outer hull skin extends across the bottom and up each side of the main hull. Preferably, the communication providing the flow of water to the water containment spaces comprises openings in only that part of the outer hull skin which extends across the bottom of the main hull.

According to a second aspect of the present invention there is provided a method of constructing or modifying a watercraft comprising the step of fitting to a main hull of the watercraft an outer hull structure which includes or which forms an outer hull skin by attaching the outer hull structure to the external surface of the main hull of the watercraft in such a manner as to provide fluid containment spaces between the outer hull skin and the main hull which free flood when the watercraft is in the water.

According to a third aspect of the present invention there is provided a watercraft having a main hull and an outer hull structure which includes or forms an outer hull skin and which is attached to the external surface of a main hull of the watercraft, the outer hull structure and its attachment to the main hull being such as to provide fluid containment spaces between the main hull and the outer hull skin which free flood when the watercraft is in water. Preferably, the outer hull structure is attached at least in part to the bottom of the main hull.

According to a fourth aspect of the present invention there is provided a watercraft having a main hull and an outer hull structure which includes or forms an outer hull skin and which is attached to the external surface of the main hull, the outer hull structure and its manner of attachment to the main hull being such as to provide fluid containment spaces between the outer hull skin and the main hull and a communication being provided for a flow of water to the fluid containment spaces.

In embodiments according to the third and fourth aspects of the invention and to a watercraft fitted with an outer hull structure by the method according to the first or second aspect of the invention, the communication providing a flow of water to the fluid containment spaces comprises controllable supply means.

The controllably supply means preferably comprises normally open valve means which close or are closable in conditions which demand closure.

In embodiments of the invention hereinafter to be described, the outer hull structure comprises a plurality of structural elements which are of such a form or forms as when assembled in predetermined positions by attachment to the main hull or to another or others of the structural elements present an outer hull skin spaced from the main hull.

In other embodiments of the invention hereinafter to be described, the outer hull structure comprises a plurality of structural elements which are of such a form or forms as when assembled in predetermined positions by attachment to the main hull or to another or other of the structural elements elements present a support surface or surfaces spaced from the main hull and wherein the outer hull structure further comprises an outer hull skin element or elements attached to the support surface or surfaces.

In one specific embodiment of the invention hereinafter to be described, the structural elements extend in the longships direction of the watercraft and the structural elements are elongate elements.

In preferred embodiments of the invention hereinafter to be described, the structural elements are attached to the main hull or to another element or elements to form sections of the outer hull structure arranged in succession along the length of the watercraft and the structural elements of each section are arranged in end-to-end relationship with the structural elements of the next adjacent section.

In an embodiment of the invention hereinafter to be described the ends of the structural elements of each section are spaced from the ends of the elements of the next adjacent section and the gap between the outer hull skin or skin elements of one section and the outer hull skin or skin elements of the next adjacent section is closed by a stress relief joint whereby the outer hull skin or skin elements of the two sections form a continuous skin at the joint while the outer hull structure remains structurally discontinuous at the junction of the section.

In another embodiment of the invention the structural elements include a stress relief zone in which parts of the structural elements are removed to relieve stress transmission in the zone and the outer skin element or elements include a stress relief joint in the zone.

In embodiments of the invention hereinafter to be described the structural elements form an open honeycomb structure comprising a first set of structural elements attached to the main hull and a second set of structural elements attached to the first set of structural elements.

Preferably, the structural elements form an outer hull skin or support an outer hull skin element or elements spaced from the main hull by a distance of between 0.1 and 0.05 of the beam of the watercraft. In particular, the structural elements form an outer hull skin or support an outer skin element or elements spaced from the main hull by a distance substantially 1/15 the beam of the watercraft.

In an embodiment of the invention hereinafter to be described the fluid containment spaces between the outer hull skin or skin elements and the main hull extend above the waterline of the watercraft and supply means are provided for supplying an inert gas to predetermined ones of the spaces. The supply means may with advantage be arranged to supply inert gas at a pressure sufficient to displace water in predetermined ones of the fluid containment spaces to a level below the waterline of the watercraft.

According to a fifth aspect of the present invention, there is provided a watercraft according to the third and fourth aspects of the invention wherein the fluid containment spaces between the outer hull skin or skin elements and the main hull comprise preselected segregated fluid containment spaces, wherein supply means are provided for supplying a pressurised inert gas to one or more of the preselected spaces, whereby the level of the water in the one or more spaces can be brought to a level below the waterline of the watercraft.

In an embodiment of the invention according to its fifth aspect the preselected fluid containment spaces extend above the waterline of the watercraft and vacuum applying means are provided for applying vacuum pressures to one or more of the preselected spaces, whereby the level of the water in the one or more spaces can be brought to a level above the waterline of the watercraft.

Preferably, the preselected spaces include one or more port and starboard spaces in the region of the bow of the watercraft and/or one or more port and starboard spaces in the region of the stern of the watercraft.

In an embodiment of the invention according to its fifth aspect and as hereinafter to be described the supply means for supplying the pressurised inert gas to predetermined ones of the preselected spaces and the vacuum applying means for applying vacuum pressures to predetermined ones of the preselected spaces are such that the water level in the predetermined ones of the selected spaces can be brought to a predetermined levels above or below the waterline of the watercraft thereby (i) to increase the overall ballast effect by increasing the level of the water in the preselected spaces, (ii) increasing the ballast effect at one end of the craft and decreasing it at the other by raising the water level to a level above the waterline of the vessel in preselected spaces at the one end and lowering the level of the water in the spaces to a level below the waterline at the other end of the vessel to alter the trim of the vessel or (iii) differentially to adjust the water levels of the water in the port and starboard preselected spaces to above and below the waterline to alter or correct a list in the watercraft.

The feature of the present invention of applying to the external surface of the main hull an outer hull structure to provide a double bottom and/or double hull either in part or in total, enables the double hull concept now to become more affordable and economically viable.

The hull modifying method of the invention furthermore minimises the disturbance to the vessels' existing internal structure and does not require the creation of tanks and void spaces internal to the vessel, which tanks and void spaces would be subject to hydrostatic pressure and pressure head due to liquid cargo.

A double bottom and hull provided in accordance with the invention can be made safer as spaces between the existing hull and the outer hull skin are flooded, which prevents accidental build up of explosive hydrocarbon gases in the spaces.

The outer hull structure when fitted in accordance with the present invention is external to the main hull causing an increase in physical depth and width of the watercraft. The depth will increase most likely by an amount equal to the beam divided by 15; e.g., in the case of 100 ft or 30 meter beam ship, 2.0 meters. Beam divided by 15 is the statistically derived ideal depth or width of a double hull, believed to reduce the accidental spillage of oil from hull damages by between 37.5 and 92 percent over a single hull tanker. If the hull sides are fitted with an outer hull structure in accordance with the invention, the hull sides will increase in width by a similar amount. In a cargo ship, these changes will ideally affect the cargo body and pump rooms only, that is the extent of the ship where cargo is carried.

In embodiments of the invention hereinafter to be described the structural elements are tubular or channel shaped and hold the outer hull skin spaced from the main hull. In preferred embodiments of the invention as hereinafter to be described the outer hull skin is substantially flat and substantially parallel to the main hull.

In embodiments of the invention hereinafter to be described the fluid containment spaces between the main hull and the outer hull skin are free-flooded and hence are at ambient hydrostatic pressure. If free-flooded the structure cannot be subject to static water pressure and therefore the structural elements can be thinner and of less weight than normally required by a conventional double bottom construction. Free flooding the spaces has a cost benefit effect by obviating the necessity for piping, venting and access systems normally associated with conventional double bottom construction.

The structural elements are preferably attached by welding to the main hull bottom and sides, and the outer hull structure is fitted in the transverse plane in alignment with the vessels' existing internal transverse structural members.

The outer hull skin element or elements can be attached e.g. by welding to the support faces of the structural elements and for a ship will be preferably of a thickness determined by the classification rules commonly used for the design and construction of ships; this outer hull skin element or elements will be substantial enough to take the wear and tear of normal ship operation including bearing loads imposed due to docking of the vessel in a dry or wet dock.

In preferred embodiments of the invention hereinafter to be described a further substantial cost saving is realised by divorcing the outer hull structure from any contribution to the watercraft's longitudinal hull strength, by rendering the outer hull structure structurally discontinuous in predetermined stress relief zones. Thus the outer hull structure components do not become part of the highly stressed bottom flange of the existing hull girder. The main hull and innerbottom of the watercraft can therefore be the sole contributor to the longitudinal strength of the watercraft and shall not be relieved of the paramount duty of providing the overall structural longitudinal strength of the watercraft. The substantial cost saving is achieved by obviating the necessity for using high tensile strength steels for the outer hull skin which are normally associated with the highly stressed plates of the hull girder.

However, there can be an advantage in making the outer skin continuous in the case of a vessel with deficient longitudinal strength, or a vessel with loading restrictions, in which case a continuous outer hull structure can add to the longitudinal strength of the vessel.

Where the structure elements form an open honeycomb support structure as a result of the build-up of sets of structural elements high energy absorbing characteristics are advantageously achieved, together with an ability to deflect under load; these are desirable features of a damage resistant structure. In this regard, the externally applied outer hull structure should perform better than a conventional double bottom and certainly better than a single hull vessel.

It is considered that the methods according to the invention can be performed in a building slip or drydock of either floating or graving type dock. The exact dimensions and plate thickness configurations and scantling of the applied outer hull structure can be provided specifically for each watercraft and sent to a classification authority for approval, in the same manner as traditional structures are determined.

Convenient lengths of the structural elements, say 40 to 60 feet for a tanker, are positioned in the dock prior to the docking of the tanker, at locations between the docking blocks. The tanker is then docked, after the tanker bottom has been inspected, shot blasted and cleaned. The structural elements are lifted in place for welding to the hull edge preparations for welding having been effected prior to positioning. The structural elements are then welded in position and built up as far as practical to the prescribed depth of outer hull skin. At this point, the docking blocks would require to be repositioned as is normal, to allow completion of the work, since they obstruct the fitting of the support members in the places where the ships' bottom rests. An alternative is to redock the tanker to a slightly offset position in the dock. This which would involve flooding the dock, repositioning the tanker, or moving the tanker by use of dockside winches in the normal manner and docking the tanker on the newly applied sections, and then completing the unfinished hull in way of the old dock block positions.

Another option available is to set the structural elements transverse across the vessel. This way provides the least impact on moving the docking blocks.

On completion of the build-up of the structural elements, or the attachment of the honeycomb support structure obtained from them on the bottom and sides of the tanker, an outer hull skin can be welded in place.

In a tanker, the side part of the outer hull structure after the turn of the bilge can have the structural elements in the vertical position thus simplifying the welding, allowing attachment to the hull and to each other by down hand welding, which produces a better quality weld by virtue of being easier to perform.

Paint and protective conservation measures can be applied in a timely fashion to the applied outer hull structure and to the main hull to cover the original coatings disturbed during the course of the work.

Preferably the sections at the bow and stern are faired into the hull lines by means of tapered sections to minimise the additional resistance of the hull and loss of speed caused by the outer hull structure and by changes in physical dimension, beam, draft virtual displacement, wetted surface of the tanker, all of which will result in a speed reduction, but not a reduction expected to outweigh the advantages of employing methods according to the invention.

Where the outer hull skin is a continuous membrane having apertures on that part of the outer skin attached to the bottom of the main hull, in the event of broach of the main hull, any oil that leaks out of the main hull will, because it is less dense than water, flow through free-flooded water containment spaces between the outer hull skin and the main hull, and will flow up the sides of the main hull until it reaches the level of the oil in the main hull. The oil will not be able to spill out from between the outer hull skin and the main hull at the sides of the watercraft because there are no apertures in the outer null skin at the sides of the watercraft.

Where the fluid containment spaces between the outer hull skin and the main hull extend above the waterline of the watercraft an inert gas can with advantage be applied to the space above the waterline to displace water in the space to a level below the waterline of the watercraft. This has the effect of reducing the draft and displacement of the watercraft and enabling an increase in the cargo carrying capacity of the watercraft.

Where stress relief joints are arranged to connect the outer hull skin elements together so that the outer hull skin forms a continuous membrane at the joints, the outer hull skin remains structurally discontinuous but there are no gaps between the outer hull skin elements.

BRIEF DESCRIPTION OF THE DRAWINGS

Several embodiments of the invention according to its different aspects will now be described by way of example with reference to the accompanying drawings in which.

DESCRIPTION OF THE PREFERRED EMBODIMENTS

Figure 1:
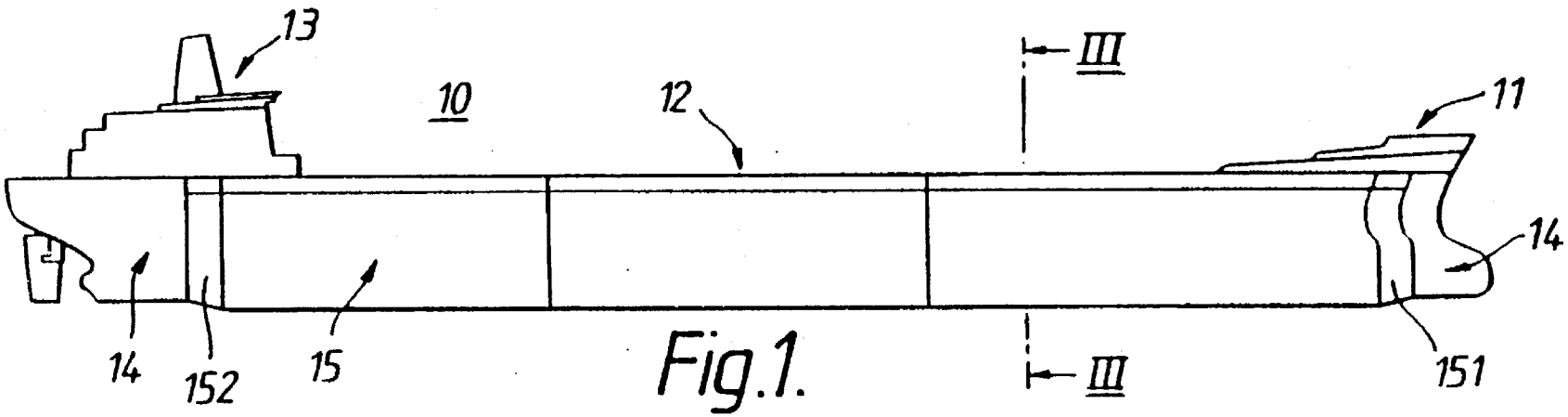
FIG. 1 is a schematic side view of a marine vessel for carrying very large crude oil cargoes to which an outer hull structure in accordance with a first embodiment of the present invention is applied
Figure 2:
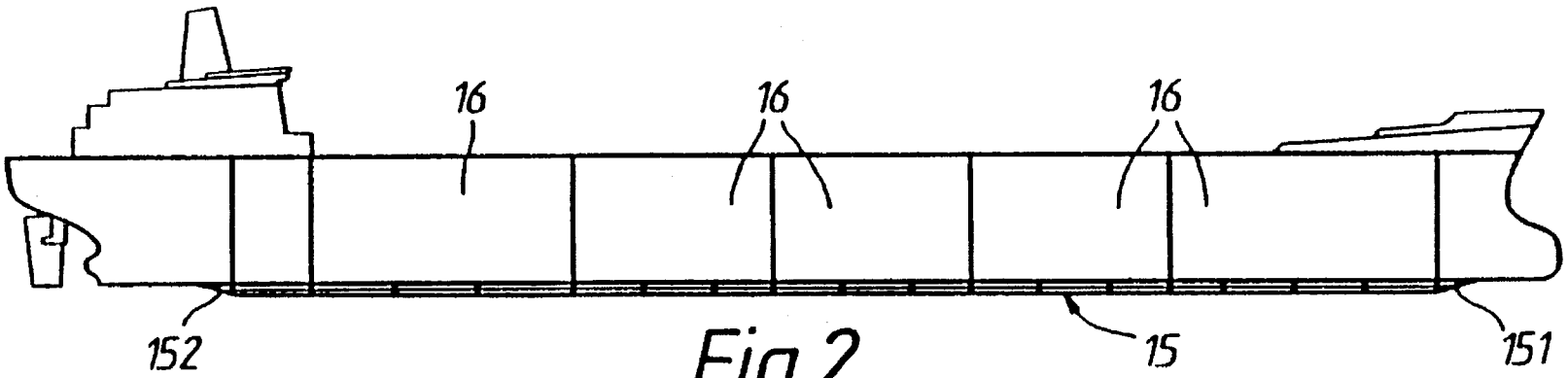
FIG. 2 is a schematic longitudinal cross-section taken on the line II—II in FIG. 3 of the vessel shown in FIG. 1

Referring first to FIG. 1, the marine vessel shown is a very large crude oil carrier (VLCC) and comprises a bow 11, a main cargo carrying body 12 and a pump room body 13. The vessel 10 is formed with a conventional main hull to which has been applied in accordance with the present invention an outer hull structure 15. The outer hull structure 15 extends for the full length of the cargo body 12 which is best seen in FIG. 2 and which comprises cargo tank sections 16.

Figure 3:
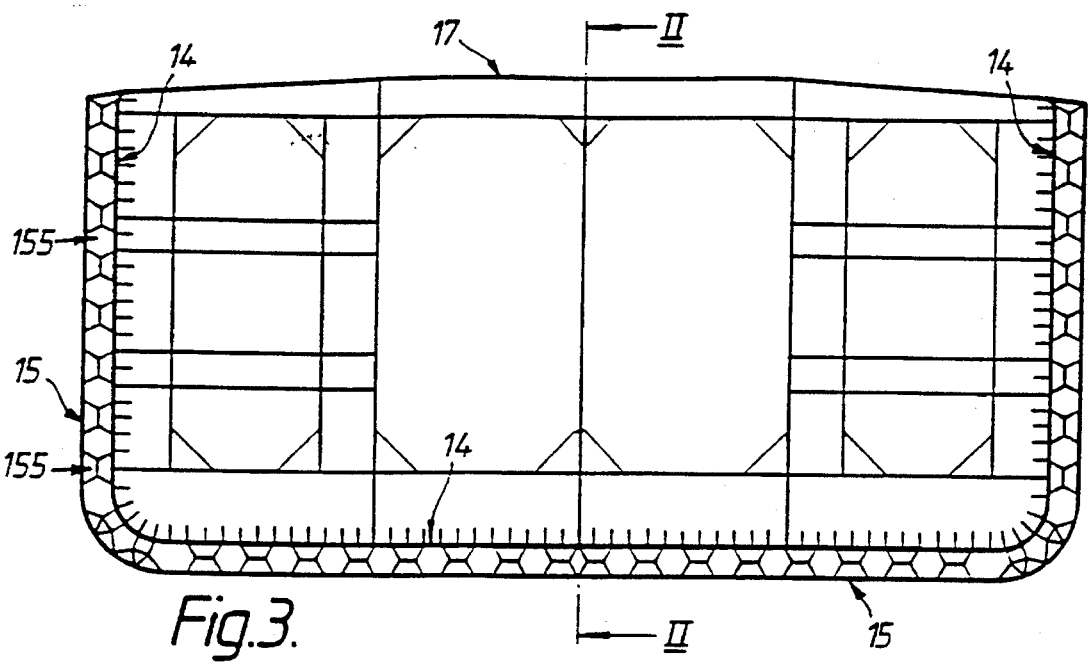
FIG. 3 is a schematic section of the vessel shown in FIG. 1, taken on the line III—III in FIG. 1

In the schematic cross-section of the vessel shown in FIG. 3, it will be seen that the outer hull structure 15 extends fully across the bottom and up each side of the main hull 14 where it terminates just below the main deck 17.

Figure 4:
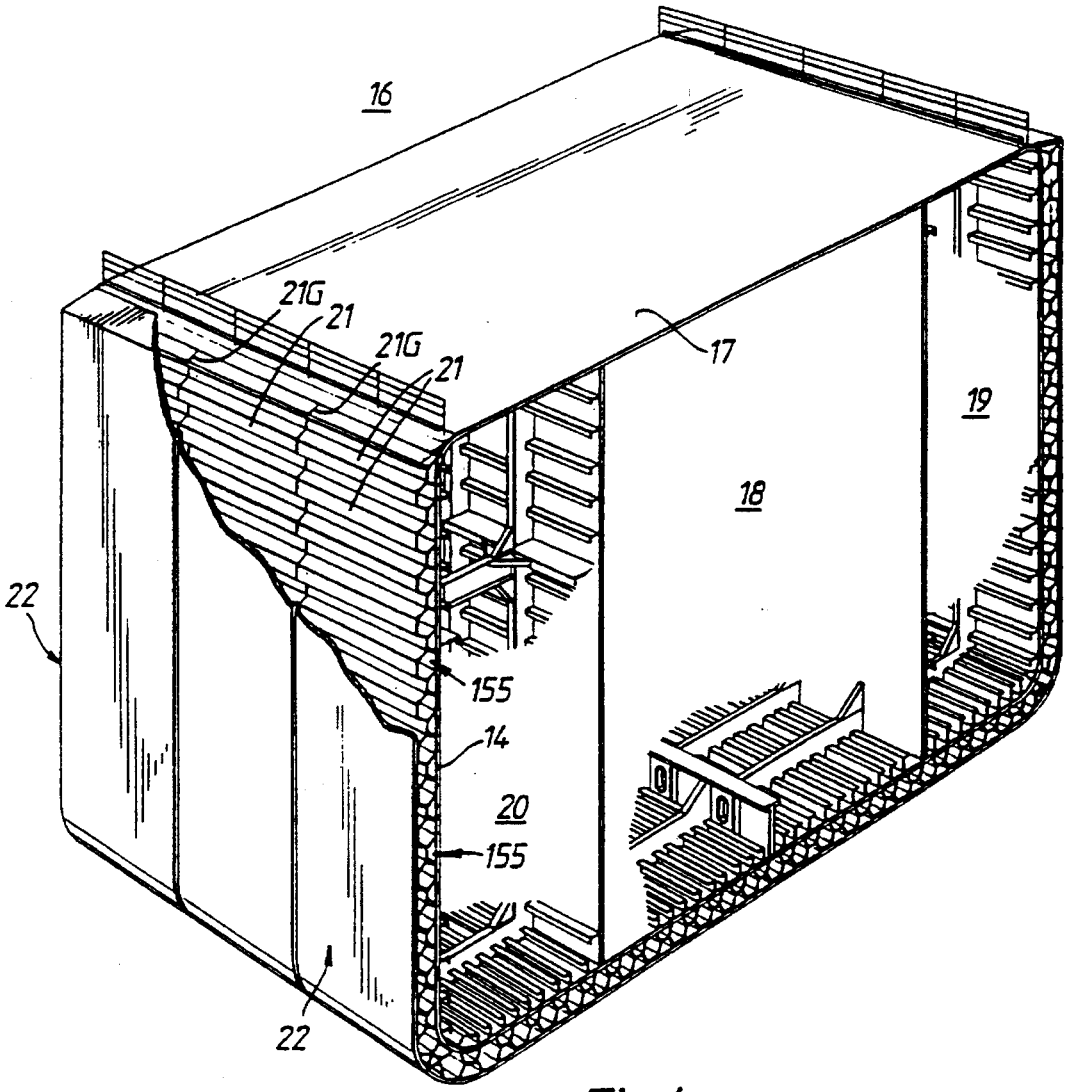
FIG. 4 is a schematic isometric view of a cargo tank section of the vessel illustrated in FIGS. 1 to 3, showing in more detail the outer hull structure applied to the main hull of the vessel in accordance with the first embodiment of the invention

Referring now to FIG. 4, one of the cargo tank sections 16 of the vessel 10 is illustrated to reveal in more detail the formation of the main hull 14 and the construction of the outer hull structure 15. The main hull 14 together with the deck 17 houses a main cargo tank 18 and port and starboard segregated tanks 19 and 20 usually employed as ballast tanks in the conventional carrier vessel. The outer hull structure 15 is built up from structural elements 21 of channel section, which are arranged one upon another to produce a cellular cross-section and which extend the length of the tank section 16. The structural elements 21 support an outer hull skin 22 and provide fluid containment spaces 155 between the main hull 14 and the outer hull skin 22.

The structural elements 21 are arranged uniformally down each side of the main hull 14 and across the full width of the bottom of the hull 14 with the distance between the main hull 14 and the outer hull skin 22 being maintained constant.

Figure 5:
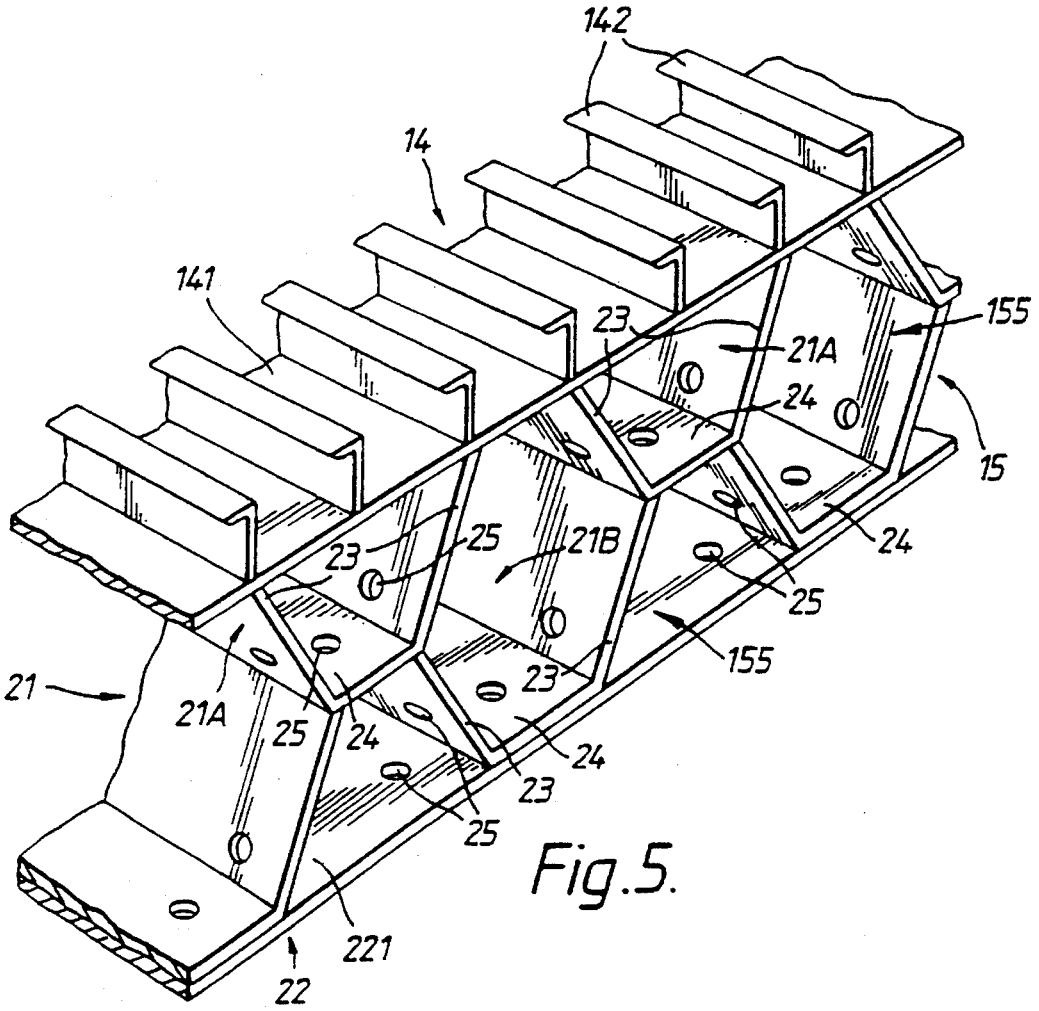
FIG. 5 is a schematic isometric scrap view illustrating in more detail the assembly of structural elements and hull skin elements forming the outer hull structure shown in FIG. 4

A scrap view of a part of the bottom of the main hull 14 together with the outer hull structure 15 applied to it is shown to an enlarged scale in FIG. 5. As will be seen, the bottom of the main hull 14 is formed by a main hull skin 141 secured to and strengthened by longitudinally extending girders 142 which are arranged with uniform spacing across the bottom of the main hull 14 and up each side of the hull 14. The structural elements 21 of the outer hull structure comprise channel shaped inner structural elements 21A and outer structural elements 21B, each having side walls 23 extending from a bridging portion 24. The side walls 23 extend as shown along the external surface of the main hull skin 141 in alignment with the girders 142 on the inside surface of the main hull skin 141, the side walls being welded to the main hull skin by any conventional welding technique. The side walls 23 of the outer structural elements 21B engage the side edges of the bridging portions 24 of the elements 21A and are welded thereto by any conventional welding technique. Finally, an outer hull skin element 221 is secured by welding to the bridging portions 24 of the outer structural elements 21B.

Openings 25 are provided in the bottom part of the outer hull skin element 221 and in the structural elements 21A and 21B to allow free-flooding of the space between the main hull 14 and the outer hull skin element 221 when the vessel is in the water.

No openings 25 are however provided in that part of the outer hull skin 22 which extends up each side of the vessel so that in the event of rupture of the main hull 14, any oil that leaks out of the main hull 14 will, because it is less dense than water, flow through the free-flooded spaces between the outer hull skin 22 and the main hull skin 141, and will flow up the sides of the main hull skin 141 until it reaches the level of the oil in the main hull 14. Oil will therefore be retained between the outer hull skin 22 and the main hull 14.

Figure 6:
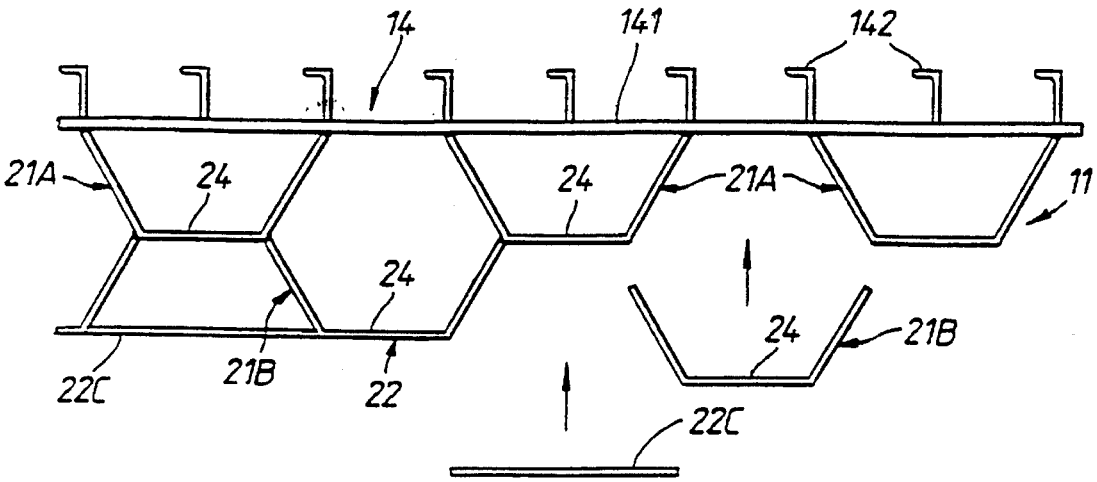
FIG. 6 is a schematic end view of an outer hull structure of an alternative form of construction of the outer hull structure according to a second embodiment of the invention which can advantageously be used in place of that illustrated in FIGS. 4 and 5 and which obviates the need for a separate outer hull skin element

In an alternative constructional form of the outer hull structure 15 shown schematically in FIG. 6, the structural elements 21A take the same form as those shown in FIG. 5 and are welded to the main hull skin 141 in the same manner and along lines of the longitudinal extending girders 142. Similarly, the outer structural elements 21B take the same form as those shown in FIG. 5 and again are welded in the same manner along the edges of the bridging portions 24 of the elements 21A to form a cellular constructions in the same manner of that provided in the arrangement shown in FIG. 5. In place of the outer hull skin element 221 of the arrangement shown in FIG. 5 individual hull skin plates 220 are welded in place as illustrated to form with the bridging portions 24 the outer hull skin 22.

Figure 7:
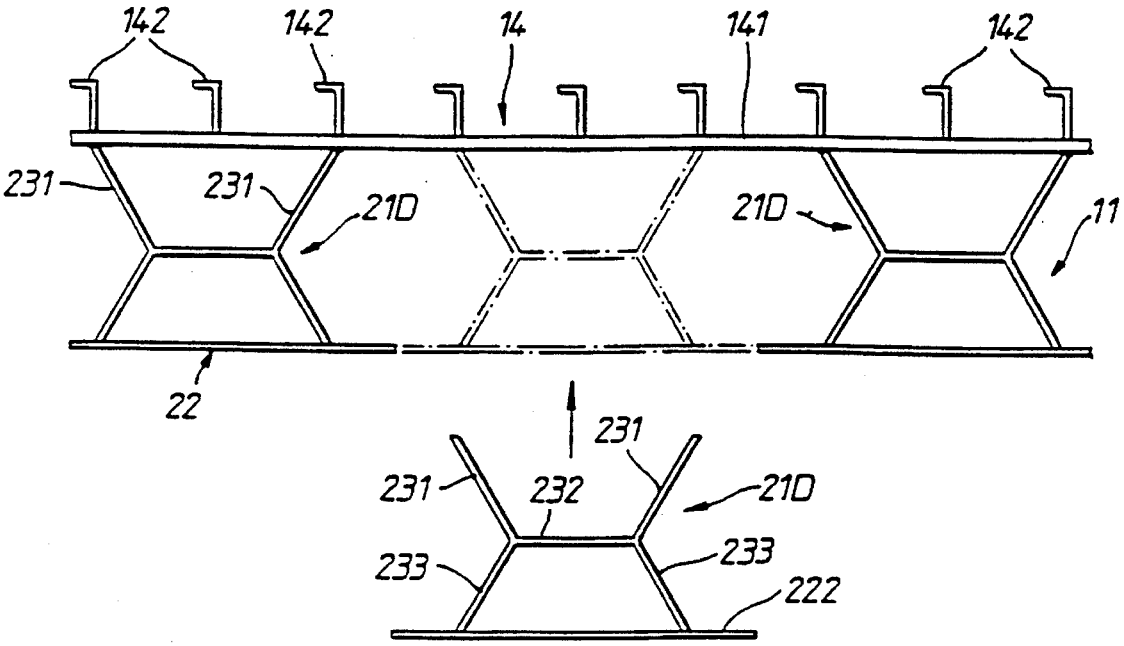
FIG. 7 is yet another alternative form of construction of the outer hull structure according to a third embodiment of the invention which can be used in place of that illustrated in FIGS. 4 and 5 and which obviates the need for a separate outer hull skin element

In yet a further alternative form of construction for the outer hull structure 15 which is shown in FIG. 7, structural units 21D are preformed to provide inner side walls 231, a common bridging portion 232 and oppositely directed outer side walls 233 to which is secured an outer hull skin element 222. Each unit 21D is secured to the main hull skin 141 by welding the inner walls 231 to the main hull skin 141 along the lines of the longitudinal girders 142. Each structural unit 21D is then welded in place, with the abutting edges of the outer hull skin elements 222 being welded together to produce a continuous outer hull skin 22.

Figure 8:
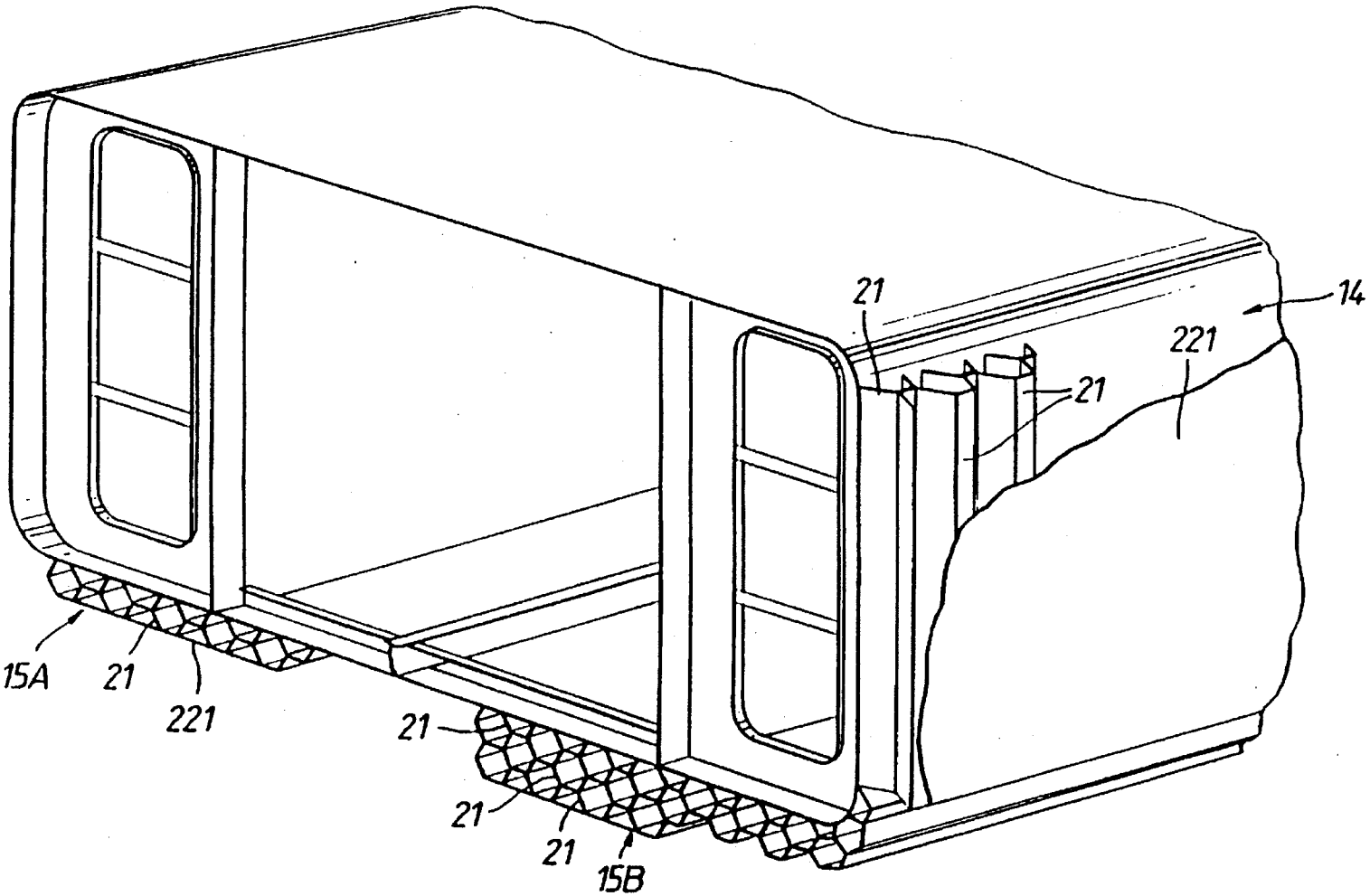
FIG. 8 is a schematic isometric view of a cargo tank section of a large crude oil carrier vessel of the type illustrated in FIGS. 1 and 2, provided with an outer hull structures in forms different from those illustrated in FIGS. 5, 6 and 7

Further alternative forms of construction for the outer hull structure 15 are illustrated in FIG. 8. While the structural elements 21 are of the same form as those illustrated in FIGS. 4 and 5, it will be seen that for that part of the outer hull structure 15 which extends up each side of the vessel, the structural elements 21 extend vertically upwardly instead of horizontally. As shown in FIG. 8, they are secured to the side of the main hull 14 and to each other in the same manner as that described for the arrangement illustrated in FIGS. 4 and 5 and are provided with an outer hull skin 221 also in the same manner.

That part of the outer hull structure 15 which extends across the bottom of the main hull 14 is formed from structural elements 21 which extend longitudinally as provided for in the arrangement described with reference to FIGS. 4 and 5. To the left side of FIG. 8, an outer hull structure 15A is shown in which the structural elements 21 are welded to the bottom of the hull 14 and to each other in the same manner as that described for the arrangement of FIG. 5 and an outer hull skin 221 is also applied in the same manner. A further alternative form of construction for the outer hull structure 15 is illustrated to the right side of FIG. 8 at 15B where three rows of spaced structural elements 21 are built up along the bottom of the main hull 14. An outer hull skin 221 is secured in place in the same manner as that for the arrangement of FIG. 5.

It will be appreciated that additional rows of structural elements 21 can be added to form an outer hull structure of the required depth and that the outer hull skin 22 can take the form of a sheet 221 applied to the structural elements or be formed by outer hull skin elements and the bridging portions of the outermost structural elements 21 or indeed take the form of structural units as illustrated in FIG. 7.

Figure 9:
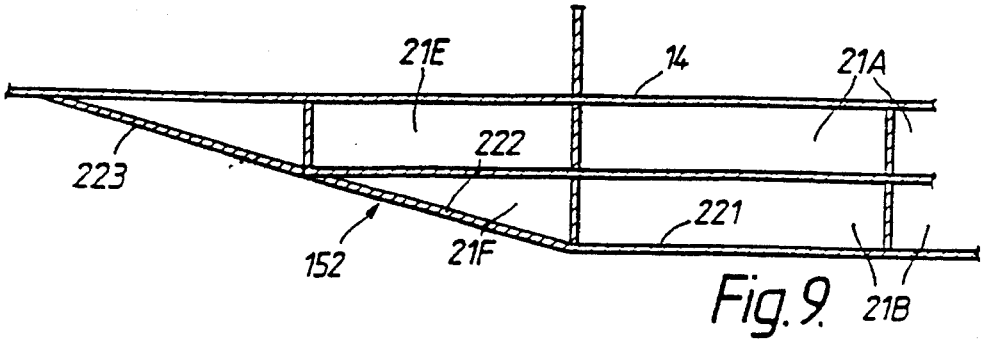
FIG. 9 is a schematic sectional side view of part of the outer hull structure illustrated in FIGS. 1 to 4 and FIGS. 5, 6 or 7, showing the manner in which the outer hull structure is faired into the main hull lines at the bow and stern of the vessel

As will be seen in FIGS. 1 and 2, the outer hull structure 15 includes end portions 151 and 152 at the bow and the stern of the vessel 10 by which the outer hull structure 15 is faired into the main hull 14. The form which the fairing end portions 151 and 152 take is illustrated schematically in FIG. 9 which shows the stern end portion 152. As can be seen from FIG. 9, the structural elements 21A and 21B, which are secured to the main hull skin 141 terminate at the rear of the outer hull structure 15 in a truncated structural element 21E and a faired structural element 21F which are secured to the main hull 14 in the same manner as the structural elements 21A and 21B and to which are secured outer hull skin elements 222 and 223, the joints between the elements with each other and with the main hull 14 being made by welding.

In the embodiments of the invention hereinbefore described with reference to FIGS. 4 and 5, the outer hull skin 22 of the outer hull structure 22 is formed by welding together hull skin elements to form a continuous membrane throughout the length of each cargo tank 16 of the vessel. It is however considered to be an advantage in certain circumstances to arrange for the outer hull structure 15 to contribute essentially no strength to the longitudinal hull strength of the vessel. To achieve this, the outer hull structure 15 needs to be made structurally discontinuous along predetermined paths so that the outer hull structural elements 21 and the outer hull skin 22 do not become part of the highly stressed components which make up the main hull 14 of the vessel.

As best seen in FIG. 4 stress relief zones 21G are provided in which the structural elements 21 include stress relief discontinuities and the outer hull skin 22 is made structurally discontinuous by the formation of a stress relief joint.

Figure 10:
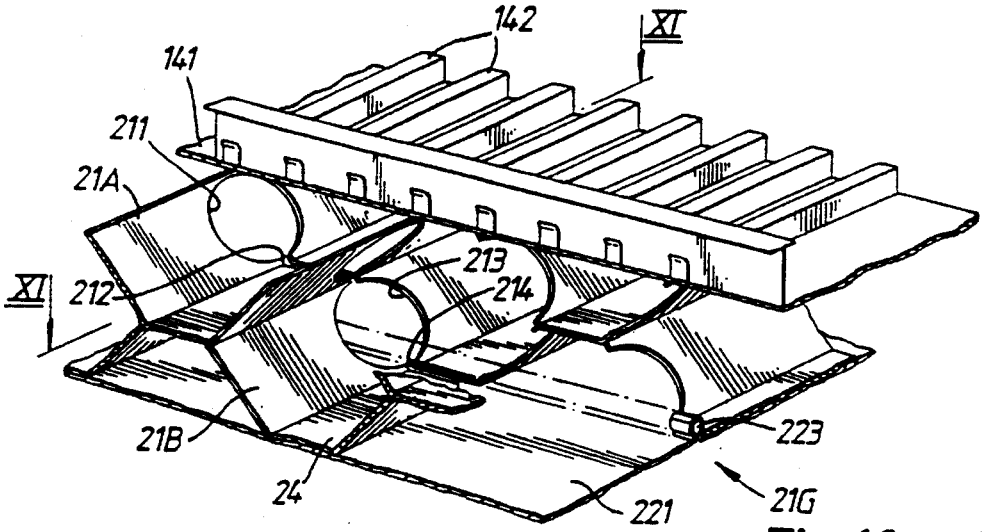
FIG. 10 is a schematic isometric view of a part of the outer hull structure illustrated in FIG. 5, showing a stress relief zone in which the outer hull structure is made structurally discontinuous
Figure 11:
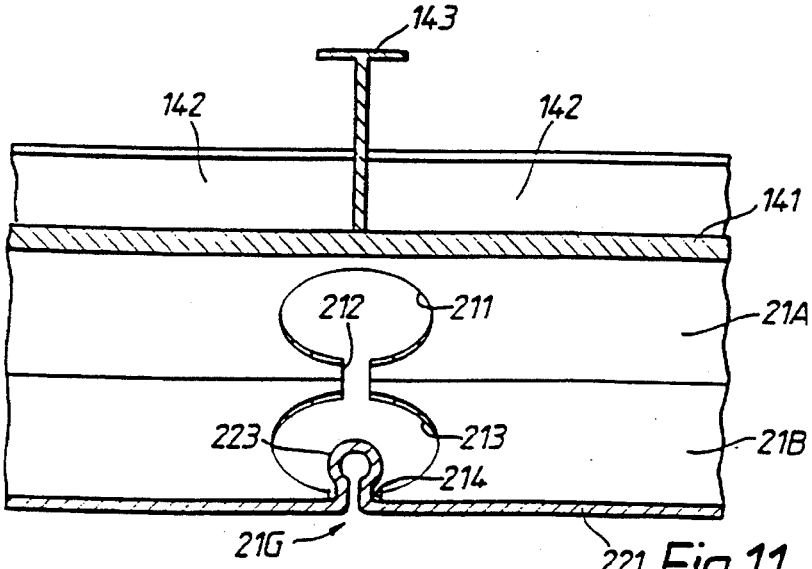
FIG. 11 is a cross-section through the outer hull structure and through the stress relief zone shown in FIG. 10, taken in a plane indicated by the reference numerals XI—XI in FIG. 10

Turning now to FIGS. 10 and 11, an isometric scrap view is shown of a part of the outer hull structure 15 which extends horizontally along the bottom part of the main hull 14. As hereinbefore described with reference to FIG. 5, upper structural elements 21A are secured to the main hull skin 141 which is supported by the longitudinally extending girders 142, while the outer structural elements 21B are secured to the inner structural elements 21A in the manner illustrated in FIG. 5. Likewise the outer hull skin element 221 is secured to the bridging portions 24 of the structural elements 21B. Stress relief is obtained by the provision of stress relief apertures 211 and slots 212 in the side walls of the upper structural elements 21A and apertures 213 and slots 214 in the side walls of the structural elements 21B. In addition the outer hull skin is formed with a stress relief joint 223.

Referring now to FIG. 11, it will be seen that the stress relief zone 21G is located in the region of the highly stressed transversely extending frame member 143 of the main hull 14 and that the stress relief joint 223 of the outer hull skin 22i is formed as an inwardly extending tubular enlargement of the hull skin element 221. In this way, the outer hull structure 15 is rendered virtually discontinuous in the zone 21G so that the main hull 14 and the components which support it can be made the sole contributors to the longitudinal strength of the vessel.

Figure 12:
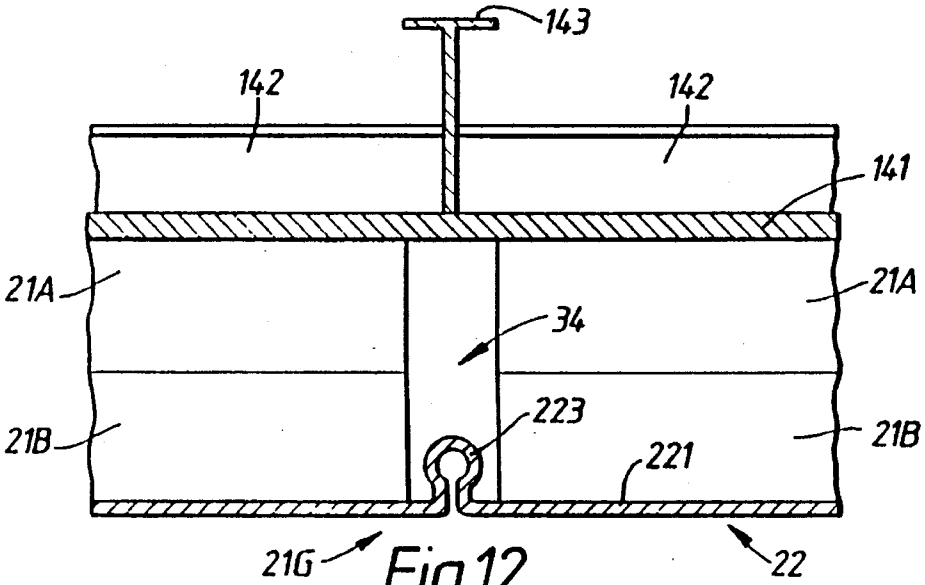
FIG. 12 is a schematic sectional view corresponding to that shown in FIG. 11 but showing an alternative means of providing a stress relief zone in the outer hull structure.

The stress relief zones 21G as shown in FIG. 4 may be replaced by an arrangement as illustrated in FIG. 12 in which the structural elements 21A and 21B terminate in the stress relief zone 21G so as to provide a gap 34 between their adjacent ends and the outer hull structure 22 is completed by an outer hull skin 221 which includes the stress relief joint 223.

In the specific embodiment of the invention hereinbefore described with reference to FIGS. 4 and 5, the outer hull structure 15 is arranged to be free flooded by the provision of openings 25 in the outer hull skin 221 and in the side walls 23 and bridging portions 24 of the structural elements 21A and 21B. While the provision of openings 25 in the outer hull skin 221 serves to provide a ready means for free flooding the spaces provided between the main hull 14 and the outer hull 22, for some applications this may be considered to be undesirable and in accordance with an alternative embodiment of the invention now to be described with reference to FIG. 12 the outer hull skin 22 is provided without openings and alternative supply means are provided for supplying water for free flooding the spaces between the outer hull skin 22 and the main hull skin 14.

Figure 13:
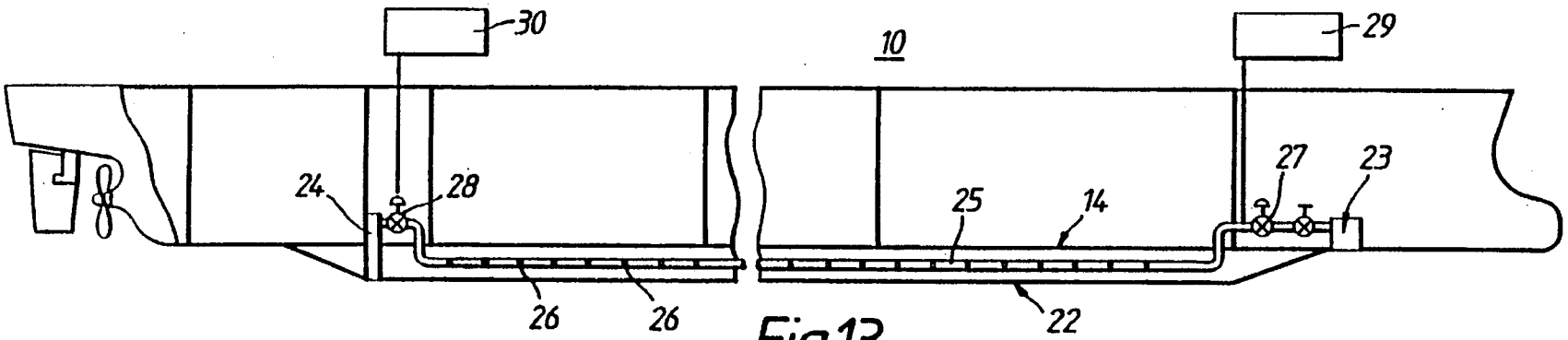
FIG. 13 is a schematic sectional side view of a large crude oil carrier vessel having an outer hull structure of the form illustrated for example in FIGS. 6 and 7 and in which supply means are provided for supplying a controlled supply of water for flooding the fluid containment spaces between the outer hull skin and the main hull

Referring now to FIG. 13, the vessel 10 shown is of the same form as the vessel 10 described with reference to FIGS. 1 and 2 and is provided with an outer hull structure 15 in any of the forms hereinbefore described with reference to FIGS. 1 to 11 except insofar that the outer hull skin 22 is without the openings and forms a continuous membrane. Supply means are nevertheless provided for free flooding the spaces between the main hull 14 and the outer hull skin 22 and comprises the provision of a bow sea water chest 23 and a stern sea water chest 24 both of which are open to the sea and to which are connected the opposite open ends of a manifold 25 which extends for the full length of the outer hull structure 15 along that part of it which is secured to the bottom of the main hull 14. The manifold 25 is of substantial diameter and extends through the outer hull structure either within the space provided by one line of structural elements 21 or by an opening specifically provided for that purpose. The manifold 25 is provided with a large plurality of orifices and the arrangement is such that sea water is free to flow via the sea water chests 23 and 24 into the manifold 25, out through the orifices 26 and into the spaces between the main hull 14 and the outer hull skin 22 so that the outer hull structure is flooded and the water in it free to rise to the level of the water within which the craft moves. Remotely controlled valves 27 and 28 are provided at opposite ends of the manifold 25 and are controlled by two oily water monitors 29 and 30 which respond to the presence of oil in the water contained within in the spaces between the main hull 14 and the outer hull skin 22 to close the valves 27 and 28 so that the spaces between the main hull 14 and the outer hull skin 22 become completely shut off.

While, in normal operation, the vessel 10 in FIG. 13, operates in a free flood mode in which the spaces between the main hull 14 and the outer hull skin 22 are free to flood to the waterline of the vessel, any rupture in the main hull resulting in the discharge of oil into the outer hull structure 15 would be sensed by monitors 29 and 30 and contained by closure of the valves 27 and 28.

Figure 14:
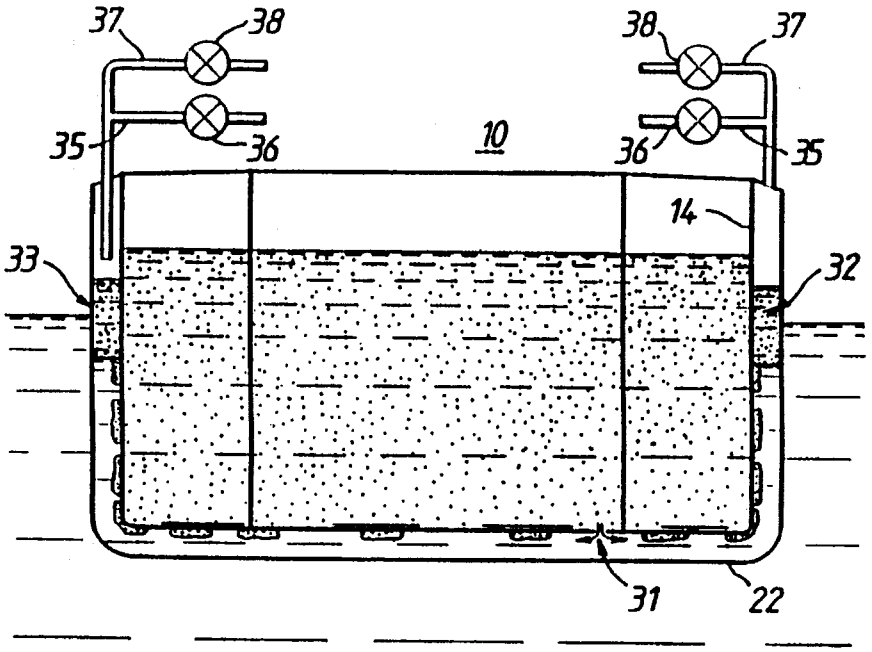
FIG. 14 is a schematic transverse cross-section of the vessel having an outer hull structure as illustrated in FIGS. 2 to 5, showing the containment of oil following rupture of the main hull of the vessel

Turning now to FIG. 14, a schematic cross-section of the vessel 10 is shown in which the presence of oil is illustrated by fine dot shading. Where a break appears in the main hull 14, for example at location 31 in FIG. 14 oil discharged from the opening 31 will travel along the bottom of the main hull 14 and then up the sides of the main hull 14 partially to fill the space between the main hull 14 and the outer hull skin 22 as shown at 32 and 33 in FIG. 13, displacing the water flooding the space between the two hull structures. The rupture 31 may result from a failure of the main hull 14 and the outer hull structure will then remain intact. The monitors 29 and 30 then sense the presence of oil and close off the valves 27 and 28 providing an effective containment of the oil leaking from the opening 31.

Where the break in the main hull 14 is caused as a result of a collision at sea and a break also appears in the outer hull skin 22, oil from the opening 31 will still follow the path shown in FIG. 14 the outer hull structure 15 will effectively contain the leaking oil for some time.

In the embodiment of the invention illustrated in FIGS. 4 and 5, where openings 25 are provided in the outer hull skin 221 a break in the main hull 14 as represented by the opening 31 in FIG. 14 will likewise give rise to containment of the oil within the outer hull structure 15 at least until the oil has completely displaced the water within the space between the main hull 14 and the outer hull skin 22.

In the embodiments of the invention hereinbefore described with reference to the drawings, it has been arranged for the fluid containment spaces between the main hull 14 and the outer hull skin 22 to become flooded to the waterline of the vessel in order to equalise the hydrostatic pressures on the outer hull structure 15. It may nevertheless be advantageous to arrange for flooding of the outer hull structure 15 to levels (i) below the draft waterline to increase buoyancy of the vessel, (ii) above the waterline to reduce the buoyancy or (iii) differentially at different parts of the vessel to alter the trim of the vessel. To achieve these ends, the outer hull skin 22 is formed without openings at least along that part of it which extends along the two sides of the vessel and means are provided for supplying an inert gas to the fluid containment spaces above the waterline of the vessel. The inert gas may be supplied to the outer hull structure 15 as shown in FIG. 14 via supply pipe 35 and valve 36 which is connected to a pump for supplying pressurised inert gas to lower the level of the water in the spaces to a level below that of the waterline of the vessel or the spaces may be subjected to vacuum pressure by connection via branch pipe 37 and valve 38 to one or more vacuum pumps for withdrawing gas from the spaces so as to raise the level of the water within the spaces to a level above that of the waterline.

Figure 15:
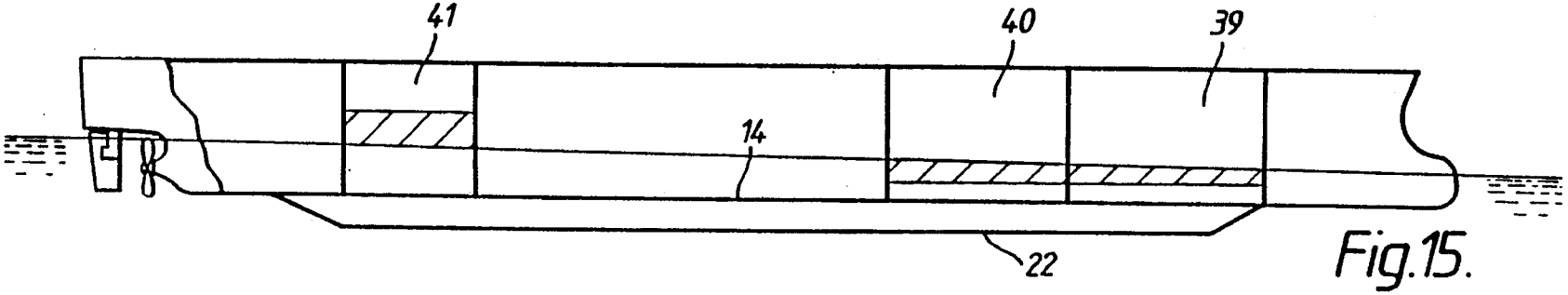
FIG. 15 is a schematic part sectional side elevation of a large crude oil carrier vessel fitted with an outer hull structure according to the invention, and illustrating the manner in which the draught of the vessel can be adjusted by adjustment of the water level in selected fluid containment spaces of the outer hull structure

To achieve an adjustment in the trim of the vessel, segregated and possibly dedicated fluid containment spaces will need to be provided within the outer hull structure 15 as for example illustrated in FIG. 15 where forward port and starboard segregated fluid containment spaces 39 and 40 are provided on the sides of the vessel 10 toward the bow and one or more port or starboard rear fluid containment spaces 41 are provided in the region of the stern of the vessel 10. Each of these spaces may be connected via separate supply lines to pumping installations for either supplying inert gas under pressure to the spaces or subjecting the spaces to vacuum pressures.

In conditions where increased buoyancy is required, all the segregated port and starboard fluid containment spaces 39, 40 and 41 on both sides of the vessel can be supplied with inert gas under pressure to lower the level of water in the spaces and effectively to increase the buoyancy of the vessel. Alternatively, when additional ballast for the vessel is required all the port and starboard fluid containment spaces 39, 40 and 41 can be subjected to vacuum pressures to raise the level of the water within the spaces.

Where the trim of the vessel needs to be adjusted for example when the vessel is transitting without cargo and with ballast only and when the draft is not quite sufficient to achieve full propeller immersion to the required depth, the trim of the vessel can be adjusted by subjecting the two spaces 41 on the port and starboard sides of the vessel to vacuum pressure to increase the ballast effect at the stern and to subject the spaces 39 and 40 to increased pressure to lower the water level within the spaces to a level below the waterline thereby to increase buoyancy in the region of the bow of the vessel. The combined effect is then to raise the bow and lower the stern within the water and achieve the required full immersion of the propeller within the water.

It will furthermore be appreciated that in the event that the vessel for one reason or another has taken up a list to port or starboard within the water the spaces 39, 40 and on one side of the vessel can be subjected to pressurised inert gas to lower the water level in the spaces and increase the buoyancy on that side of the vessel while the corresponding spaces on the other side of the vessel can be subjected to vacuum pressures to increase the ballast effect on that side of the vessel.

A double bottom construction offers many advantages over a single bottom but primarily it results in a structure that can withstand a considerable amount of bottom damage caused by grounding without flooding of the cargo tanks or loss of cargo to the sea. Ships fitted with double bottoms will remain afloat on the inner hull (also known as the tank top) when the bottom has been severely damaged.

The invention is not limited to the prevention of marine pollution, but is applicable to any type of ship or vessel which would benefit from the installation of an outer hull structure according to the invention.

The watercraft to which this invention especially applies are those that carry oil or bulk materials, or vessels which carry liquids which are hazardous to the environment if spilled on the seas or navigable waterways of the world.

Other advantages to be gained from employing the method of hull modification according to the invention and the watercraft so modified are as follows:

1. By virtue of the additional depth of the double hull, the minimum draft requirements can be met without utilizing salt water ballast. This enables oil tanks which have been previously converted for ballast to once again be utilized for the carriage of oil.
2. The lightweight outer hull structure aids in ensuring the main hull oil barrier is not penetrated on grounding by virtue of the relative thickness, i.e. the outer hull structure collapses or shears rather than allowing piercing of the hull.
3. The capability to utilize the spaces between the hulls at the forward and aft end to trim the vessel to ensure propeller immersion. The spaces between the hulls can be selectively pressurized to deballast or subjected to vacuum pressures to induce a trim to ensure propeller immersion. This feature is important as it is necessary under international rules to obtain propeller immersion and minimum drafts for safe navigation.

I claim:

1. A watercraft having a main hull and an outer hull structure which includes an outer hull skin and which is attached to an external surface of the main hull of the watercraft, wherein the outer hull structure comprises a plurality of elongate structural elements forming sections of the outer hull structure arranged in succession along the length of the watercraft, the ends of the structural elements of each outer hull structure section are spaced from the ends of the elements of the next adjacent outer hull structure section, each structural element comprising a base portion having first and second opposite edges and first and second outwardly inclined side walls which respectively extend from the first and second edges of the base portion in directions which are away from the plane of the base portion and on the same side of the base portion, wherein when the structural elements are assembled in predetermined positions by attachment to the main hull and to one another they form an open celled structure between the main hull and the outer hull skin and wherein an outer hull skin part of one section and an outer hull skin part of the next adjacent section are connected to one another by a stress relief joint whereby the outer hull skin parts of the two sections form a continuous skin at the joint while the outer hull structure remains structurally discontinuous at the junction of the section.

2. A watercraft having a main hull and an outer hull structure which includes an outer hull skin and which is attached to an external surface of the main hull of the watercraft, wherein the outer hull structure comprise a plurality of structural elements, each structural element comprising a base portion having first and second opposite edges and first and second outwardly inclined side walls which respectively extend from the first and second edges of the base portion in directions which are away from the plane of the base portion and on the same side of the base portion, wherein when the structural elements are assembled in predetermined positions by attachment to the main hull and to one another they form an open celled structure between the main hull and outer hull skin, wherein the structural elements include a stress relief zone in which parts of the structural elements are removed to relieve stress transmission in the zone and the outer hull skin includes a stress relief joint in the zone.

3. A watercraft having a main hull and an outer hull structure which includes an outer hull skin and which is attached to an external surface of the main hull of the watercraft, wherein the outer hull structure comprises a plurality of channel shaped structural elements, each structural element comprising a base portion having first and second opposite edges and first and second outwardly inclined side walls which respectively extend from the first and second edges of the base portion in directions which are away from the plane of the base portion and on the same side of the base portion, wherein when the structural elements are assembled in predetermined positions by attachment to the main hull and to one another they form an open honeycomb structure between the main hull and the outer skin comprising a first set of structural elements attached to the main hull and a second set of structural elements attached to the first set of structural elements.

4. A watercraft having a main hull and an outer hull structure which includes an outer hull skin and which is attached to the external surface of the main hull of the watercraft and extends across the bottom and up each side of the main hull, wherein the outer hull structure and its attachment to the main hull is such as to provide fluid containment spaces between the main hull and the outer hull skin which can free flood to the level of the water within which the watercraft moves when the watercraft is in the water in all operative conditions of the watercraft in the water, wherein the fluid containment spaces between the outer hull skin and the main hull extend above the watercraft, and wherein supply means are provided for supplying an inert gas to the spaces.

5. A watercraft having a main hull and an outer hull structure which includes an outer hull skin and which is attached to the external surface of the main hull of the watercraft and extends across the bottom and up each side of the main hull, wherein the outer hull structure and its attachment to the main hull is such as to provide fluid containment spaces between the main hull and the outer hull skin which can free flood to the level of the water within which the watercraft moves when the watercraft is water in all operative conditions of the watercraft in the water, wherein the fluid containment spaces between the outer hull skin and the main hull extend above the waterline of the watercraft and vacuum applying means are provided for applying vacuum pressures to the spaces.

6. A watercraft having a main hull and an outer hull structure which includes an outer hull skin and which is attached to the external surface of the main hull of the watercraft and extends across the bottom and up each side of the main hull, wherein the outer hull structure and its attachment to the main hull is such as to provide fluid containment spaces between the main hull and the outer hull skin which can free flood to the level of the water within which the watercraft moves when the watercraft is in the water in all operative conditions of the watercraft in the water, wherein the fluid containment spaces between the outer hull skin and the main hull comprise preselected segregated fluid containment spaces, and wherein supply means are provided for supplying a pressurized inert gas to at least one of the preselected spaces, whereby the level of the water in the at least one space can be brought to a level below the waterline of the watercraft.

7. A watercraft according to claim 6, wherein the preselected fluid containment spaces extend above the waterline of the watercraft and wherein vacuum applying means are provided for applying vacuum pressures to at least one of the preselected spaces, whereby the level of the water in the at least one space can be brought to a level above the waterline of the watercraft.

8. A watercraft according to claim 7 wherein the preselected spaces include at least one port and starboard space in at least the region of the bow of the watercraft.

9. A watercraft according to claim 8, wherein said pressurized inert gas supply means for supplying an inert gas to predetermined ones of the preselected spaces and said vacuum applying means for applying vacuum pressures to predetermined ones of the preselected spaces are such that the water level in the predetermined ones of the preselected spaces can be brought to predetermined levels above or below the waterline of the watercraft thereby (i) to increase the overall ballast effect by increasing the level of the water in the preselected spaces, (ii) increasing the ballast effect at one end of the craft and decreasing it at the other by raising the water level to a level above the waterline of the vessel in preselected spaces at the one end and lowering the level of the water in the spaces to a level below the waterline at the other end of the vessel to alter the trim of the vessel or (ii) differentially to adjust the water levels of the water in the port and starboard preselected spaces to above and below the waterline to alter or correct a list in the watercraft.

* * * * *